US007144499B2

(12) United States Patent
Han et al.

(10) Patent No.: US 7,144,499 B2
(45) Date of Patent: Dec. 5, 2006

(54) DESULFURIZATION PROCESS

(75) Inventors: Yuan-Zhang Han, West Chester, PA (US); David W. Leyshon, West Chester, PA (US)

(73) Assignee: Lyondell Chemical Technology, L.P., Greenville, DE (US)

( * ) Notice: Subject to any disclaimer, the term of this patent is extended or adjusted under 35 U.S.C. 154(b) by 432 days.

(21) Appl. No.: 10/723,870

(22) Filed: Nov. 26, 2003

(65) Prior Publication Data

US 2005/0109677 A1 May 26, 2005

(51) Int. Cl.
*C10G 29/28* (2006.01)

(52) U.S. Cl. ..... 208/208 R; 208/240; 208/196

(58) Field of Classification Search ..... 208/208 R, 208/240, 196

See application file for complete search history.

(56) References Cited

U.S. PATENT DOCUMENTS

| | | | | |
|---|---|---|---|---|
| 2,593,761 | A * | 4/1952 | Johnstone | 208/191 |
| 3,565,793 | A | 2/1971 | Herbstman et al. | 208/208 |
| 3,816,301 | A | 6/1974 | Sorgenti | 208/208 |
| 3,970,545 | A | 7/1976 | Yoo et al. | 208/212 |
| 4,367,342 | A | 1/1983 | Wulff et al. | 549/529 |
| 5,759,945 | A | 6/1998 | Carroll et al. | 502/242 |
| 5,985,136 | A | 11/1999 | Brignac et al. | 208/216 |
| 6,011,162 | A | 1/2000 | Han et al. | 549/529 |
| 6,114,552 | A | 9/2000 | Han et al. | 549/529 |
| 6,171,478 | B1 | 1/2001 | Cabrera et al. | 208/212 |
| 6,187,934 | B1 | 2/2001 | Tsuji et al. | 549/529 |
| 6,323,147 | B1 | 11/2001 | Yamamoto et al. | 502/64 |
| 6,402,939 | B1 | 6/2002 | Yen et al. | 208/196 |
| 6,551,501 | B1 * | 4/2003 | Whitehurst et al. | 208/211 |
| 2005/0189261 | A1 * | 9/2005 | Briot et al. | 208/243 |
| 2006/0000750 | A1 * | 1/2006 | Louis et al. | 208/208 R |

FOREIGN PATENT DOCUMENTS

| | | |
|---|---|---|
| EP | 0345856 | 12/1989 |
| EP | 0492697 | 7/1992 |
| WO | WO 2003093203 A1 * | 11/2003 |

OTHER PUBLICATIONS

R. Castillo et al., *J. Catalysis 161* (1996) 524.

* cited by examiner

*Primary Examiner*—Tam M. Nguyen
(74) *Attorney, Agent, or Firm*—Kevin M. Carroll

(57) ABSTRACT

This invention is a method of purifying fuel streams containing organosulfur impurities. The fuel stream is oxidized with an organic hydroperoxide in the presence of an oxidation catalyst to form a sulfone product. The alcohol product of the organic hydroperoxide is then removed from the oxidized fuel stream, followed by extraction of the sulfone product by solid-liquid extraction using solid adsorbents. The alcohol removal step is found to improve the adsorption capacity of the solid adsorbents.

16 Claims, No Drawings

DESULFURIZATION PROCESS

FIELD OF THE INVENTION

This invention relates to a process for removing organosulfur impurites found in fuel streams. The process comprises oxidizing the organosulfur impurites by reaction with an organic hydroperoxide in the presence of a sulfur oxidation catalyst to produce sulfones, then removing the alcohol product of the oxidation reaction prior to solid-liquid extraction of the sulfones using a solid adsorbent. The alcohol removal step is found to improve the adsorption capacity of the solid adsorbents.

BACKGROUND OF THE INVENTION

Hydrocarbon fractions produced in the petroleum industry are typically contaminated with various sulfur impurities. These hydrocarbon fractions include diesel fuel and gasoline, including natural, straight run and cracked gasolines. Other sulfur-containing hydrocarbon fractions include the normally gaseous petroleum fraction as well as naphtha, kerosene, jet fuel, fuel oil, and the like. The presence of sulfur compounds is undesirable since they result in a serious pollution problem. Combustion of hydrocarbons containing these impurities results in the release of sulfur oxides which are noxious and corrosive.

Federal legislation, specifically the Clean Air Act of 1964 as well as the amendments of 1990 and 1999 have imposed increasingly more stringent requirements to reduce the amount of sulfur released to the atmosphere. The United States Environmental Protection Agency has lowered the sulfur standard for diesel fuel to 15 parts per million by weight (ppmw), effective in mid-2006, from the present standard of 500 ppmw. For reformulated gasoline, the current standard of 300 ppmw has been lowered to 30 ppmw, effective Jan. 1, 2004.

Because of these regulatory actions, the need for more effective desulfurization methods is always present. Processes for the desulfurization of hydrocarbon fractions containing organosulfur impurities are well known in the art. The most common method of desulfurization of fuels is hydrodesulfurization, in which the fuel is reacted with hydrogen gas at elevated temperature and high pressure in the presence of a costly catalyst. U.S. Pat. No. 5,985,136, for example, describes a hydrodesulfurization process to reduce sulfur level in naptha feedstreams. Organic sulfur is reduced by this reaction to gaseous $H_2S$, which is then oxidized to elemental sulfur by the Claus process. Unfortunately, unreacted $H_2S$ from the process is harmful, even in very small amounts. Although hydrodesulfurization readily converts mercaptans, thioethers, and disulfides, other organsulfur compounds such as substituted and unsubstituted thiophene, benzothiophene, and dibenzothiophene are difficult to remove and require harsher reaction conditions.

Because of the problems associated with hydrodesulfurization, research continues on other sulfur removal processes. For instance, U.S. Pat. No. 6,402,939 describes the ultrasonic oxidation of sulfur impurities in fossil fuels using hydroperoxides, especially hydrogen peroxide. These oxidized sulfur impurities may be more readily separated from the fossil fuels than non-oxidized impurities. Another method involves the desulfurization of hydrocarbon materials where the fraction is first treated by oxidizing the sulfur-containing hydrocarbon with an oxidant in the presence of a catalyst. U.S. Pat. No. 3,816,301, for example, discloses a process for reducing the sulfur content of sulfur containing hydrocarbons by oxidizing at least of portion of the sulfur impurities with an organic hydroperoxide such as t-butyl hydroperoxide in the presence of certain catalysts. The catalyst described is preferably a molybdenum-containing catalyst.

In sum, new methods to remove the sulfur compound impurities in hydrocarbon fractions are required. We have discovered an efficient process for removing sulfur compound impurities from fuel streams.

SUMMARY OF THE INVENTION

This invention is a process for removing organosulfur impurites found in fuel streams. The process comprises contacting the fuel stream with an organic hydroperoxide in the presence of a sulfur oxidation catalyst to convert a substantial portion of the organosulfur impurities to sulfones. In this step, the organic hydroperoxide is converted into the corresponding alcohol on reaction with the organosulfur impurities. The alcohol is first removed from the fuel stream and the sulfones are then extracted from the fuel stream by solid-liquid extraction using a solid adsorbent to form a purified fuel stream. We found that the alcohol removal step prior to sulfone extraction results in greater adsorption capacity for the adsorbent.

DETAILED DESCRIPTION OF THE INVENTION

The process of the invention comprises oxidizing organosulfur impurities found in fuel streams with an organic hydroperoxide in the presence of a sulfur oxidation catalyst. Any oxidation catalyst that oxidizes the organosulfur impurities to sulfones is sufficient. Sulfur oxidation catalysts are described in, for example, U.S. Pat. Nos. 3,565,793 and 3,816,301, the teachings of which are incorporated herein by reference. Suitable oxidation catalysts include soluble Group 4–6 transition metal such as compounds of titanium, zirconium, vanadium, chromium, and molybdenum (e.g., molybdenum hexacarbonyl). Suitable oxidation catalysts also include supported Group 4–6 transition metals that comprise a Group 4–6 transition metal and a support such as silica, alumina, clays, carbon, and the like.

Most preferably, the oxidation catalyst is a titanium-containing silicon oxide catalyst. Titanium-containing silicon oxide catalysts are well known and are described, for example, in U.S. Pat. Nos. 4,367,342, 5,759,945, 6,011,162, 6114,552, 6,187,934, 6,323,147, European Patent Publication Nos. 0345856 and 0492697 and Castillo et al., *J. Catalysis* 161, pp. 524–529 (1996), the teachings of which are incorporated herein by reference in their entirety.

Such titanium-containing silicon oxide catalysts typically comprise an inorganic oxygen compound of silicon in chemical combination with an inorganic oxygen compound of titanium (e.g., an oxide or hydroxide of titanium). The inorganic oxygen compound of titanium is preferably combined with the oxygen compound of silicon in a high positive oxidation state, e.g., tetravalent titanium. The proportion of the inorganic oxygen compound of titanium contained in the catalyst composition can be varied, but generally the catalyst composition contains, based on total catalyst composition, at least 0.1% by weight of titanium with amounts from about 0.2% by weight to about 50% by weight being preferred and amounts from about 0.2% to about 10% by weight being most preferred.

One class of titanium-containing silicon oxide catalysts particularly suitable for the oxidation of organosulfur impurities is titania-on-silica (also sometimes referred to as "$TiO_2/SiO_2$"), which comprises titanium (titanium sometimes referred to as "$TiO_2/SiO_2$"), which comprises titanium (titanium dioxide) supported on silica (silicon dioxide). The titania-on-silica may be in either silylated or nonsilylated form.

The preparation of titania-on-silica catalysts may be accomplished by a variety of techniques known in the art. One such method involves impregnating an inorganic siliceous solid support with a titanium tetrahalide (e.g., $TiCl_4$), either by solution or vapor-phase impregnation, followed by drying and then calcination at an elevated temperature (e.g., 500° C. to 900° C.). Vapor-phase impregnation is described in detail in European Patent Pub. No. 0345856 (incorporated herein by reference in its entirety). U.S. Pat. No. 6,011,162 discloses a liquid-phase impregnation of silica using titanium halide in a non-oxygen containing solvent. In another technique, the catalyst composition is suitably prepared by calcining a mixture of inorganic siliceous solids and titanium dioxide at elevated temperature, e.g., 500° C. to 1000° C. Alternatively, the catalyst composition is prepared by cogelling a mixture of a titanium salt and a silica sol by conventional methods of preparing metal supported catalyst compositions.

The titanium-containing silicon oxide catalysts may optionally incorporate non-interfering and/or catalyst promoting substances, especially those which are chemically inert to the oxidation reactants and products. The catalysts may contain minor amounts of promoters, for example, alkali metals (e.g., sodium, potassium) or alkaline earth metals (e.g., barium, calcium, magnesium) as oxides or hydroxides. Alkali metal and/or alkaline earth metal levels of from 0.01 to 5% by weight based on the total weight of the titanium-containing silicon oxide catalyst composition are typically suitable.

The oxidation catalyst may be employed in any convenient physical form such as, for example, powder, flakes, granules, spheres or pellets.

The organosulfur oxidation process of the invention comprises contacting the fuel stream containing organosulfur impurities with an organic hydroperoxide in the presence of the oxidation catalyst. Suitable fuel streams include diesel fuel and gasoline, including natural, straight run and cracked gasolines. Other sulfur-containing fuel streams include the normally gaseous petroleum fraction as well as naphtha, kerosine, jet fuel, fuel oil, and the like. Diesel fuel is a particularly preferred fuel stream.

Preferred organic hydroperoxides are hydrocarbon hydroperoxides having from 3 to 20 carbon atoms. Particularly preferred are secondary and tertiary hydroperoxides of from 3 to 15 carbon atoms. Exemplary organic hydroperoxides suitable for use include t-butyl hydroperoxide, t-amyl hydroperoxide, cyclohexyl hydroperoxide, ethylbenzene hydroperoxide, and cumene hydroperoxide. T-butyl hydroperoxide is especially useful.

In such an oxidation process the organosulfur compound: hydroperoxide molar ratio is not particularly critical, but it is preferable to employ a molar ratio of approximately 2:1 to about 1:5.

The oxidation reaction is conducted in the liquid phase at moderate temperatures and pressures. Suitable reaction temperatures vary from 0° C. to 200° C., but preferably from 25° C. to 150° C. The reaction is preferably conducted at or above atmospheric pressure. The precise pressure is not critical. Typical pressures vary from 1 atmosphere to 100 atmospheres.

The oxidation reaction may be performed using any of the conventional reactor configurations known in the art for such oxidation processes. Continuous as well as batch procedures may be used. For example, the catalyst may be deployed in the form of a fixed bed or slurry.

The oxidation process of the invention converts a substantial portion of the organosulfur impurities into sulfones. Typically, greater than about 50 percent of the organosulfur impurities are converted into sulfones, preferably greater than about 80 percent, and most preferably greater than about 90 percent. The oxidation process of the invention also converts a substantial portion of the organic hydroperoxide to the corresponding alcohol. For instance, tertiary butyl alcohol results if tertiary butyl hydroperoxide is used as the organic peroxide. Typically, greater than about 50 percent of the organic hydroperoxide is converted into the corresponding alcohol, preferably greater than about 80 percent, and most preferably greater than about 90 percent. The starting organic hydroperoxide solution may also contain the corresponding alcohol. We have discovered that the presence of alcohol in the fuel stream has a negative effect upon the removal of sulfones from the fuel stream.

When the oxidation has proceeded to the desired extent, the product mixture may be treated using a solid-liquid extraction process to remove the sulfones from the fuel stream. Prior to the sulfone removal step, it is necessary to remove the alcohol product of the oxidation step, deriving from the organic hydroperoxide. The alcohol may be removed by any conventional technique, such as simple distillation and/or stripping the fuel stream after oxidation with a gas such as carbon dioxide or nitrogen. The alcohol may also be separated from the fuel stream by a liquid-liquid extraction step in which the fuel stream is contacted with a polar solvent such as water or an alcohol (such as methanol) that is immiscible with the fuel stream. We have found that the alcohol removal step improves the adsorption capacity of the solid adsorbents used in the sulfone removal step.

Following alcohol removal, the sulfones may be removed from the fuel stream by solid-liquid extraction with at least one solid adsorbent. The adsorbents useful in the invention include any adsorbent capable of removing the sulfones from fuel streams. Useful adsorbents include clays, inorganic oxides such as aluminum oxides, silicon oxides, silica-aluminas, zeolitic materials such as zeolite Y, Zeolite X, ZSM-5, and mixtures thereof. The adsorbent may also comprise a Group 3 to 10 transition metal supported on a support such as silica or alumina. Examples include titania-on-silica or iron-on-alumina. Mixtures of the adsorbents may also be employed. Particularly useful adsorbents include silicas, aluminas, and silica-aluminas.

The adsorptive contact is conveniently carried out at temperatures in the range of about 15° C. to 90° C., preferably 20° C. to 40° C. The flow rates are not critical, however flow rates of about 0.5 to 10 volumes of the fuel stream per volume of adsorbent per hour are preferred, with a flow rate of about 1 to 5 volumes particularly preferred. It is generally preferred to employ more than one adsorbent contact beds so that a depleted bed can be regenerated while a fresh bed is used. Regeneration can be accomplished by first draining the fuel stream, and washing the adsorbent bed with a hydrocarbon solvent or solvent mixture such as heptane to remove the residual fuel stream from the adsorbent. The fuel stream may be recovered from the hydrocarbon solvent by any method such as evaporation of the hydrocarbon solvent. The adsorbent bed is then washed with a polar solvent or solvent mixture such as water, methanol, or other solvents, followed by drying or by stripping with a heated inert gas such as steam, nitrogen or the like. The polar solvent of solvent mixture may be recovered, by, e.g., distillation, for reuse in regeneration.

When a titanium-containing silicon oxide catalyst is used in the oxidation step of the process, the titanium-containing silicon oxide catalyst tends to slowly deteriorate in performance when used repeatedly or in a continuous process.

The deterioration appears to be associated with the presence of organonitrogen impurities in the fuel stream itself. Removal of the organonitrogen impurities prior to the oxidation step is therefore a preferred embodiment of the process of the invention. Prior to oxidation of the organosulfur impurities, the fuel stream may be subjected to an organonitrogen removal step.

The removal of organonitrogen impurities from fuel streams is typically accomplished by extraction techniques. Purification by extraction methods is well-known in the art. Suitable extraction methods include, but are not limited to, solid-liquid extractions using adsorbents and liquid-liquid extractions using polar solvents. In a typical solid-liquid extraction, the fuel stream is contacted in the liquid phase with at least one solid adsorbent. The adsorbents useful in the invention include any adsorbent capable of removing organonitrogen impurities from fuel streams. Useful adsorbents include clays, inorganic oxides such as aluminum oxides, silicon oxides, silica-aluminas, zeolitic materials such as zeolite Y, zeolite X, ZSM-5, basic adsorbents such as oxides, hydroxides or salts of alkaline or alkaline earth metals, and sulfonic acid resins such as Amberlyst 15 (available from Rohm and Haas). Acidic adsorbents may be useful. Acidic adsorbents include clays, inorganic oxides, and zeolitic materials that have been treated with an acid such as HCl, HF, phosphoric acid, and the like. Basic adsorbents may also be useful. Basic adsorbents include oxides, hydroxides, or salts of alkaline or alkaline earth metals. The oxides, hydroxides, or salts of alkaline or alkaline earth metals may also be supported on supports such as silica, alumina, silica-aluminas, carbon, and the like. Mixtures of the adsorbents may also be employed. Particularly useful adsorbents include aluminum oxides, silica-aluminas, magnesium oxides, and zeolite Y. Particularly useful adsorbent mixtures include magnesium oxides and silica-aluminas.

The adsorptive contact is conveniently carried out at temperatures in the range of about 15° C. to 90° C., preferably 20° C. to 40° C. The flow rates are not critical, however flow rates of about 0.5 to 10 volumes of the fuel stream per volume of adsorbent per hour are preferred, with a flow rate of about 1 to 5 volumes particularly preferred. It is generally preferred to employ more than one adsorbent contact beds so that a depleted bed can be regenerated while a fresh bed is used. Regeneration can be accomplished by first draining the fuel stream, and washing the adsorbent bed with a hydrocarbon solvent or solvent mixture such as heptane to remove the residual fuel stream from the adsorbent. The fuel stream may be recovered from the hydrocarbon solvent by any method such as evaporation of the hydrocarbon solvent. The adsorbent bed is then washed with a polar solvent or solvent mixture such as water, methanol, or other solvents, followed by drying or by stripping with a heated inert gas such as steam, nitrogen or the like. The polar solvent of solvent mixture may be recovered, by, e.g., distillation, for reuse in regeneration.

In a typical liquid-liquid extraction process, an impure stream is contacted with an extraction liquid. The extraction liquid is immiscible with and has a different (usually lower) density than the impure stream. The mixture is intimately mixed by any of a variety of different techniques. During the intimate mixing, the impurity passes from the impure stream into the extraction liquid, to an extent determined by the so-called partition coefficient of such substance in the conditions concerned. Extraction processes may be operated batch-wise or continuously. The impure stream may be mixed with an immiscible extraction liquid in an agitated vessel, after which the layers are settled and separated. The extraction may be repeated if more than one contact is required. Most extraction equipment is continuous, with either successive stage contacts or differential contacts. Typical liquid extraction equipment includes mixer-settlers, vertical towers of various kinds which operate by gravity flow, agitated tower extractors, and centrifugal extractors.

The liquid-liquid extraction embodiment of the invention comprises contacting the fuel stream containing organonitrogen and organosulfur impurities with a polar solvent. Any polar solvent that is immiscible and having a different density than the fuel stream may be used. Particular preferred polar solvents are selected from the group consisting of alcohol, ketone, water, and mixtures thereof. The alcohol may be any alcohol that is immiscible with the fuel stream, and is preferably a $C_1$–$C_4$ alcohol, most preferably methanol. The ketone may be any ketone that is immiscible with the fuel stream, and is preferably a $C_3$–$C_8$ aliphatic ketone, such as acetone and methyl ethyl ketone, or mixtures of ketones containing acetone. Especially preferred solvents include mixtures of alcohol and water, most preferably a methanol-water mixture. When alcohol-water mixtures are used as the extraction solvent, the mixture preferably comprises about 0.5 to about 50 weight percent water, most preferably from about 1 to about 10 weight percent water. The solvent:fuel stream ratio is not critical but preferably is from about 10:1 to about 1:10.

Other extraction media, both solid and liquid, will be readily apparent to those skilled in the art of extracting polar species. In the process of the invention, the extraction step removes at least 50 percent of the nitrogen content from the fuel stream. Preferably, more than about 70 percent of the nitrogen content in the fuel stream is removed during extraction. After extraction, the fuel stream is then separated and recovered using known techniques.

Following the extraction of organonitrogen impurities, and separating and recovering the fuel stream having a reduced amount of organonitrogen impurities, the fuel stream is then passed through to the oxidation step.

A fuel product is produced by the process of the invention.

The following examples merely illustrate the invention. Those skilled in the art will recognize many variations that are within the spirit of the invention and scope of the claims.

EXAMPLE 1

Preparation of Titania-on-silica Catalist

Silica (Grace Davison DAVICAT P-732) is dried at 400° C. in air for 4 hours. The dried silica (39.62 g) is charged into a 500-mL 3-neck round-bottom flask equipped with an inert gas inlet, a gas outlet, and a scrubber containing aqueous sodium hydroxide solution. Into the flask described above, a solution consisting of n-heptane (84.21 g, 99+%, water <50 ppm) and *titanium* (IV) tetrachloride (5.02 g) is added under dry inert gas atmosphere. The mixture is mixed well by swirling. The solvent is removed by heating with an oil bath at 125° C. under nitrogen flow for 1.5 hours.

A portion of above material (35 g) is calcined by charging it into a tubular quartz reactor (1 inch ID, 16 inch long)

equipped with a thermowell, a 500 mL 3-neck round-bottom flask, a heating mantle, an inert gas inlet, and a scrubber (containing sodium hydroxide solution). The catalyst bed is heated to 850° C. under dry nitrogen (99.999%) flow (400 cc/min). After the bed is maintained at 850° C. for 30 min, the power to the furnace is turned off and the catalyst bed is cooled to 400° C.

The catalyst is then hydrated by the following procedure. Water (3.0 g) is added into the 3-neck round-bottom flask and the flask is heated with a heating mantle to reflux while maintaining the nitrogen flow at 400 cc/min. The water is distilled through the catalyst bed over a period of 30 minutes. A heat gun is used to heat the round-bottom flask to ensure that any residual water is driven out of the flask through the bed. The bed is then maintained at 400° C. for an additional 2 hours before cooling.

The catalyst is then silylated as follows. A 500 mL 3-neck round-bottom flask is equipped with a condenser, a thermometer, and an inert gas inlet. The flask is charged with heptane (39 g, water <50 ppm), hexamethyldisilazane (3.10 g) and the non-silylated catalyst prepared above (11.8 g). The system is heated with oil bath to reflux (98° C.) for 2 hours under inert atmosphere before cooling. The catalyst is filtered and washed with heptane (100 mL). The material is then dried in a flask under inert gas flow at 180–200° C. for 2 hours. The titania-on-silica catalyst contains 3.5 wt. % Ti and 1.97 wt. % C.

EXAMPLE 2

Oxidation of Sulfur Impurities in Diesel Fuel Using Nitrogen Estracted Fuel

Chevron/Phillips diesel containing 30 ppm N and 380 ppm S is tested in a continuous oxidation run using the titania-on-silica catalyst. First, untreated diesel is pretreated by passing the diesel over an alumina bed to remove organonitrogen impurities so that the nitrogen content of fuel is less than 7 ppm N.

The oxidation step is run according to the following procedure. A reaction mixture of 99% diesel fuel (plus toluene) and 1% Lyondell TBHP oxidate (containing approximately 43 wt. % TBHP and 56 wt. % tertiary butyl alcohol) is fed to a fixed-bed reactor containing titania-on-silica catalyst (50 cc, 21 g) at a liquid hourly space velocity of 3 $hr^{-1}$, a temperature of 80° C. The diesel is fed to the reactor at 150 cc/hr. A 1:1 mixture of toluene:TBHP oxidate is fed to the reactor at 3 cc/hr. The oxidized diesel fuel stream is then collected for sulfone adsorption testing.

EXAMPLE 3

Adsorption of Sulfone from Oxidized Diesel Fuel by Solid Adsorbents

The oxidized diesel fuel from Example 2 is tested for sulfur removal using Silica gel V-432 (a product of Grace Davison), Alumina Selexorb COS (a product of Alcoa), and Alumina Selexorb CDX (a product of Alcoa). Oxidized diesel fuel (25 g, containing 280 ppm S) and adsorbent powder (1 g) are mixed for 24 hours. After filtering, the diesel fuel is analyzed for S content. In comparative run 3A, the diesel fuel is run as effluent from the oxidizer. In runs 3B and 3C, the feeds are obtained by stripping the oxidized diesel under vacuum to remove io a portion of TBA. The feed used in run 3D is obtained by water washing the oxidized diesel fuel followed by rotary evaporation under vacuum to remove residual water. The results are summarized in Table 1.

The results indicate that TBA has a significant influence on the adsorption of sulfones. In fact, TBA is more strongly adsorbed by adsorbents than S-species. TBA can be effectively removed from the feed by distillation under vacuum, or water wash. Removing TBA from the feed significantly increases adsorption capacity for sulfones.

EXAMPLE 4

Continuous Adsorption of Sulfones

The continuous fixed bed adsorption of sulfones is conducted using 32.26 g (77 cc) of granular silica gel V-432 (0.6–1.4 mm, product of Grace Davison), dried at 200° C. The oxidized diesel fuel is passed upflow over the bed at a flow rate of 67 cc/h at 20° C.

Using an untreated oxidized diesel fuel that contains 280 ppm S and 0.826 wt. % TBA, the adsorption capacity of the bed is determined to be approximately 3 bed volumes as determined by the breakthrough of sulfones. Using an oxidized diesel fuel that contains 280 ppm S and 0.013 wt. % TBA that is prepared by washing oxidized diesel fuel with water followed by stripping of the residual water, the adsorption capacity of the bed is determined to be approximately 15 bed volumes.

TABLE 1

Sulfone Removal from Diesel Fuel

| Run | Sulfur in diesel fuel after adsorption (ppm) | | |
|---|---|---|---|
| | V432 | CDX | COS |
| 3A* (0.826% TBA) | 241 | 257 | 274 |
| 3B (0.251% TBA) | 130 | 189 | 230 |
| 3C (0.034% TBA) | 65 | 131 | 148 |
| 3D (no TBA) | 50 | 101 | 110 |

*Comparative Example

We claim:

1. A process comprising:

(a) contacting a fuel stream containing organosulfur impurities with an organic hydroperoxide in the presence of an oxidation catalyst to form an oxidized fuel stream, wherein a substantial portion of the organosulfur impurities are converted into sulfones and a substantial portion of the organic hydroperoxide is converted into an alcohol;

(b) removing the alcohol from the oxidized fuel stream to form an alcohol-reduced oxidized fuel stream; and (c) extracting the sulfones from the alcohol-reduced oxidized fuel stream by solid-liquid extraction using a sulfone adsorbent.

2. The process of claim 1 wherein the organic hydroperoxide is t-butyl hydroperoxide and the alcohol is t-butyl alcohol.

3. The process of claim 1 wherein the oxidation catalyst is a titanium-containing silicon oxide catalyst.

4. The process of claim 3 wherein the titanium-containing silicon oxide catalyst is titania-on-silica.

5. The process of claim 1 wherein the alcohol is removed by distillation.

6. The process of claim 1 wherein the sulfone adsorbent is selected from the group consisting of silicas, aluminas, and silica-aluminas.

7. A process comprising:

(a) extracting organonitrogen impurities from a fuel stream containing organonitrogen and organosulfur impurities whereby the nitrogen content of fuel stream is reduced by at least 50 percent to produce a fuel stream having a reduced amount of organonitrogen impurities;

(b) separating and recovering the fuel stream having a reduced amount of organonitrogen impurities;

(c) contacting the separated fuel stream having a reduced amount of organonitrogen impurities with an organic hydroperoxide in the presence of a titanium-containing silicon oxide catalyst to form an oxidized fuel stream, wherein a substantial portion of the organosulfur impurities are converted into sulfones and a substantial portion of the organic hydroperoxide is converted into an alcohol;

(d) removing the alcohol from the oxidized fuel stream to form an alcohol-reduced oxidized fuel stream; and (e) extracting the sulfones from the alcohol-reduced oxidized fuel stream by solid-liquid extraction using a sulfone adsorbent.

8. The process of claim 7 wherein the organonitrogen impurities are extracted by solid-liquid extraction using at least one organonitrogen adsorbent.

9. The process of claim 8 wherein the organonitrogen adsorbent is selected from the group consisting of aluminum oxide, silicon oxide, silica-alumina, zeolite Y, Zeolite X, ZSM-5, magnesium oxide, and sulfonic acid resin.

10. The process of claim 7 wherein the organonitrogen impurities are extracted by liquid-liquid extraction using at least one polar solvent.

11. The process of claim 10 wherein the polar solvent is selected from the group consisting of a $C_1$–$C_4$ alcohol, a $C_3$–$C_8$ ketone, water, and mixtures thereof.

12. The process of claim 10 wherein the polar solvent is a mixture of methanol and water.

13. The process of claim 7 wherein the organic hydroperoxide is t-butyl hydroperoxide and the alcohol is t-butyl alcohol.

14. The process of claim 7 wherein the titanium-containing silicon oxide catalyst is titania-on-silica.

15. The process of claim 7 wherein the alcohol is removed by distillation.

16. The process of claim 1 wherein the sulfone adsorbent is selected from the group consisting of silicas, aluminas, and silica-aluminas.

* * * * *